US009163617B2

(12) United States Patent
Mann

(10) Patent No.: US 9,163,617 B2
(45) Date of Patent: Oct. 20, 2015

(54) HIGH PRESSURE PUMP INCLUDING HOLLOW STUD

(75) Inventor: Michael D. Mann, Joplin, MO (US)

(73) Assignee: KMT Waterjet Systems Inc., Baxter Springs, KS (US)

( * ) Notice: Subject to any disclaimer, the term of this patent is extended or adjusted under 35 U.S.C. 154(b) by 555 days.

(21) Appl. No.: 13/228,685

(22) Filed: Sep. 9, 2011

(65) Prior Publication Data

US 2012/0063939 A1 Mar. 15, 2012

Related U.S. Application Data

(60) Provisional application No. 61/381,742, filed on Sep. 10, 2010.

(51) Int. Cl.

| | |
|---|---|
| ***F04B 17/00*** | (2006.01) |
| ***F04B 9/113*** | (2006.01) |
| ***F04B 53/16*** | (2006.01) |
| ***F04B 3/00*** | (2006.01) |
| ***F04B 9/105*** | (2006.01) |

(52) U.S. Cl.
CPC . *F04B 9/113* (2013.01); *F04B 3/00* (2013.01); *F04B 9/105* (2013.01); *F04B 53/168* (2013.01)

(58) Field of Classification Search
CPC ..... F04B 9/105; F04B 9/113; F04B 53/168
USPC ..... 417/225, 567, 569
See application file for complete search history.

(56) References Cited

U.S. PATENT DOCUMENTS

| | | | | |
|---|---|---|---|---|
| 3,016,717 | A * | 1/1962 | Gottzmann | 62/50.6 |
| 3,106,169 | A * | 10/1963 | Prosser et al. | 417/567 |
| 3,207,081 | A | 9/1965 | Bauer | |
| 3,282,219 | A | 11/1966 | Blackwell et al. | |
| 3,602,613 | A | 8/1971 | Gunther | |
| 3,657,972 | A | 4/1972 | Strebel et al. | |
| 3,659,967 | A * | 5/1972 | McArthur et al. | 417/397 |
| 3,890,882 | A | 6/1975 | Bobier | |
| 3,997,111 | A | 12/1976 | Thomas et al. | |
| 4,412,792 | A | 11/1983 | LaBorde et al. | |
| 4,536,135 | A | 8/1985 | Olsen et al. | |
| 4,551,077 | A | 11/1985 | Pacht | |
| 4,682,531 | A | 7/1987 | Mayer | |
| 4,862,911 | A * | 9/1989 | Yie | 137/454.4 |

(Continued)

FOREIGN PATENT DOCUMENTS

| | | |
|---|---|---|
| JP | 7217551 | 8/1998 |

*Primary Examiner* — Charles Freay

(74) *Attorney, Agent, or Firm* — Michael Best & Friedrich LLP

(57) ABSTRACT

A high-pressure fluid pump is operable to pressurize a fluid and includes a hollow stud including a first end, a second end, and a cylindrical space extending between the first end and the second end and a housing fixedly coupled to the first end of the hollow stud. A high pressure cylinder is disposed within the cylindrical space of the hollow stud. The high pressure cylinder includes a bore that extends from a first end to a second end of the high pressure cylinder. A seal head is engaged with the first end of the high pressure cylinder to define a seal therebetween and an end cap is coupled to the second end of the hollow stud and the seal head. The end cap is operable to apply a compressive force to the seal head to compress the seal head against the cylinder and to apply a tensile load to the hollow stud. A plunger is movable within the bore to pressurize the fluid in a space defined by the piston, the seal head, and the high pressure cylinder.

21 Claims, 6 Drawing Sheets

(56) References Cited

U.S. PATENT DOCUMENTS

| | | | | | |
|---|---|---|---|---|---|
| 4,960,039 | A | | 10/1990 | Robertson | |
| 5,037,276 | A | | 8/1991 | Tremoulet, Jr. | |
| 5,064,354 | A | | 11/1991 | Robertson et al. | |
| 5,075,950 | A | * | 12/1991 | Steinbock | 29/426.5 |
| 5,092,744 | A | * | 3/1992 | Boers et al. | 417/397 |
| 5,302,087 | A | | 4/1994 | Pacht | |
| 5,337,561 | A | * | 8/1994 | Raghavan et al. | 60/421 |
| 5,346,037 | A | * | 9/1994 | Flaig et al. | 184/24 |
| 5,609,477 | A | * | 3/1997 | Saurwein | 417/567 |
| 6,209,445 | B1 | | 4/2001 | Roberts, Jr. et al. | |
| 6,216,573 | B1 | * | 4/2001 | Moutafis et al. | 83/177 |
| 6,241,492 | B1 | | 6/2001 | Pacht | |
| 6,588,318 | B2 | | 7/2003 | Aday et al. | |
| 7,287,460 | B2 | | 10/2007 | Riley et al. | |
| 7,367,789 | B2 | | 5/2008 | Raghavan et al. | |
| 7,523,694 | B2 | | 4/2009 | Aday et al. | |
| 7,775,559 | B2 | * | 8/2010 | Steinbock et al. | 285/90 |
| 2006/0127228 | A1 | | 6/2006 | Rohring | |

* cited by examiner

HIGH PRESSURE PUMP INCLUDING HOLLOW STUD

RELATED APPLICATION DATA

This application claims priority to provisional patent application No. 61/381,742 filed Sep. 10, 2010, the entire contents of which are incorporated herein by reference.

BACKGROUND

The present invention relates to high pressure fluid pumps, and more particularly to head attachment assemblies for high pressure fluid pumps.

High pressure pumps can be used in a variety of applications such as providing a high pressure fluid for a water jet cutting device. The high pressure (in excess of 50 ksi) required to produce a cutting jet necessitates the use of high pressure sealing systems and other high strength components.

SUMMARY

In one embodiment, the invention provides a high-pressure fluid pump that is operable to pressurize a fluid. The pump includes a hollow stud including a first end, a second end, and a cylindrical space extending between the first end and the second end and a housing fixedly coupled to the first end of the hollow stud. A high pressure cylinder is disposed within the cylindrical space of the hollow stud. The high pressure cylinder includes a bore that extends from a first end to a second end of the high pressure cylinder. A seal head is engaged with the first end of the high pressure cylinder to define a seal therebetween and an end cap is coupled to the second end of the hollow stud and the seal head. The end cap is operable to apply a compressive force to the seal head to compress the seal head against the cylinder and to apply a tensile load to the hollow stud. A plunger is movable within the bore to pressurize the fluid in a space defined by the piston, the seal head, and the high pressure cylinder.

In another embodiment, the invention provides a high-pressure fluid pump operable to pressurize a fluid. The pump includes a high pressure cylinder including a bore and a high pressure end, a plunger positioned at least partially within the bore, a power source operable to produce a reciprocating motion of the plunger within the bore, and a housing. A hollow stud has a first end fixedly coupled to the housing and a cylindrical space that extends between the first end and a second end of the hollow stud. The high pressure cylinder is disposed at least partially within the cylindrical space. A seal head is positioned adjacent the high pressure end of the high pressure cylinder such that the seal head, the high pressure cylinder and the plunger cooperate to define a variable volume space that receives the fluid to be pressurized. An end cap is coupled to the second end of the hollow stud and is operable to apply a compressive force to the seal head and the high pressure cylinder to maintain a seal therebetween at operating pressures in excess of 30,000 psi (2,069 bars) and to apply a tensile force to the hollow stud.

In yet another embodiment the invention provides a high-pressure fluid pump that is operable to pressurize a fluid. The pump includes a power cylinder having a hydraulic drive member disposed therein, a first housing coupled to a first end of the power cylinder and cooperating with the power cylinder and the drive member to define a first space, and a second housing coupled to a second end of the power cylinder and cooperating with the power cylinder and the drive member to define a second space. A first hollow stud has a first end connected to the first housing and a second end, a first head assembly is coupled to the second end of the first hollow stud, and a first high pressure cylinder is disposed within the first hollow stud and has a first cylindrical bore that at least partially defines a space. The first head assembly is adjustable to apply a tensile load to the first hollow stud and to compress the first high pressure cylinder between the first head assembly and the first housing. A first plunger is disposed within the first cylindrical bore, a second hollow stud has a first end connected to the second housing and a second end, and a second head assembly is coupled to the second end of the second hollow stud. A second high pressure cylinder is disposed within the second hollow stud and has a second cylindrical bore. The second head assembly is adjustable to apply a tensile load to the second hollow stud and to compress the second high pressure cylinder between the second head assembly and the second housing. A second plunger is disposed within the second cylindrical bore. The first plunger and the second plunger are movable in response to movement of the drive member and in opposition to one another to pressurize the fluid to a pressure in excess of 30,000 psi (2,069 Bar).

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

It should be noted that "high pressure" as used herein refers to pressure in excess of 30,000 psi (2,069 bar). One of ordinary skill in the art will realize that unique problems occur at these high pressures. Thus, solutions common to lower pressure pumps are not necessarily applicable in systems operating at pressures in excess of 30,000 psi (2,069 bar).

Figure 1:
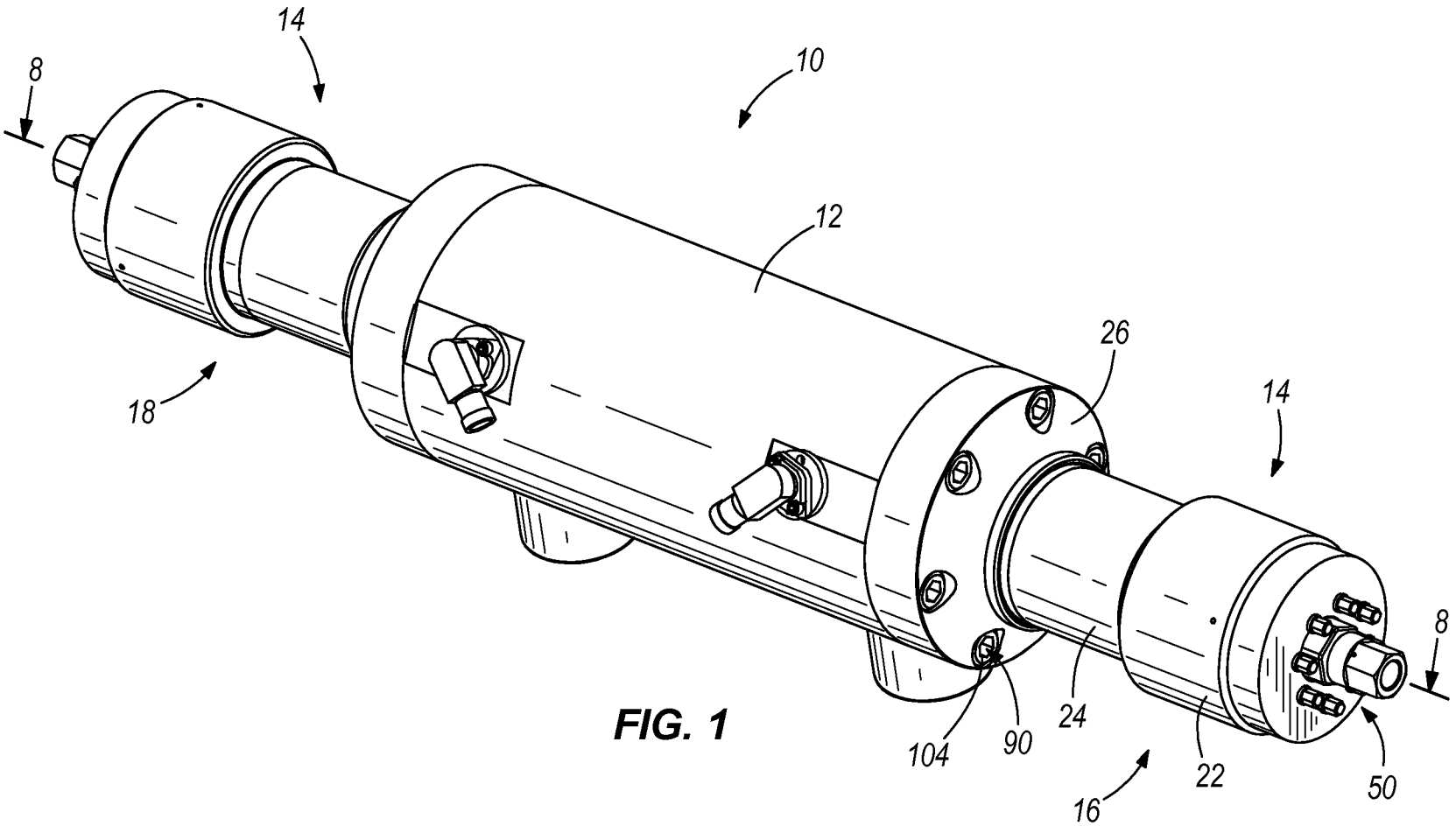
FIG. 1 is a perspective view of a portion of a high pressure pump.

FIG. 1 is a perspective view of a double acting high pressure pump 10. The embodiment described herein is a double acting high pressure pump, however, the invention can also be applied to a single acting high pressure pump or a mechanically actuated pump if desired. The pump 10 includes a power cylinder 12, a pump head 14 disposed on a first end 16 of the pump 10 and another pump head 14 disposed on a second end 18 of the pump 10. The first end 16 and second end 18 are substantially identical and capable of delivering high-pressure fluid during pump operation. As the first end 16 and second end 18 are substantially identical, only one end 16 will be described in detail.

Figure 8:
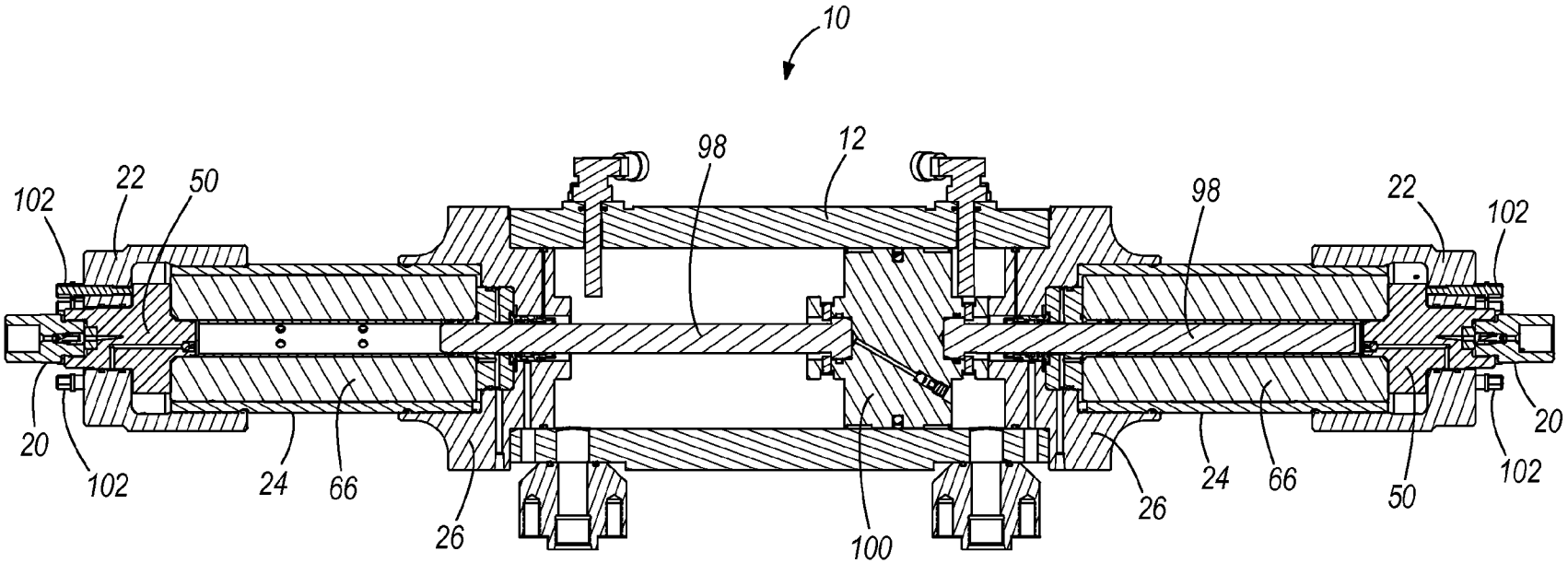
FIG. 8 is a section view of the pump of FIG. 1 taken along line 9-9 of FIG. 1.

As is best illustrated in FIG. 8, the end 16 includes a sealing head 50 partially disposed inside an end cap 22. One end of a hollow stud 24 is connected to the end cap 22 and the opposite end of the hollow stud is coupled to a hydraulic cylinder head 26. The hydraulic cylinder head 26 is coupled to the power cylinder 12.

Figure 2:
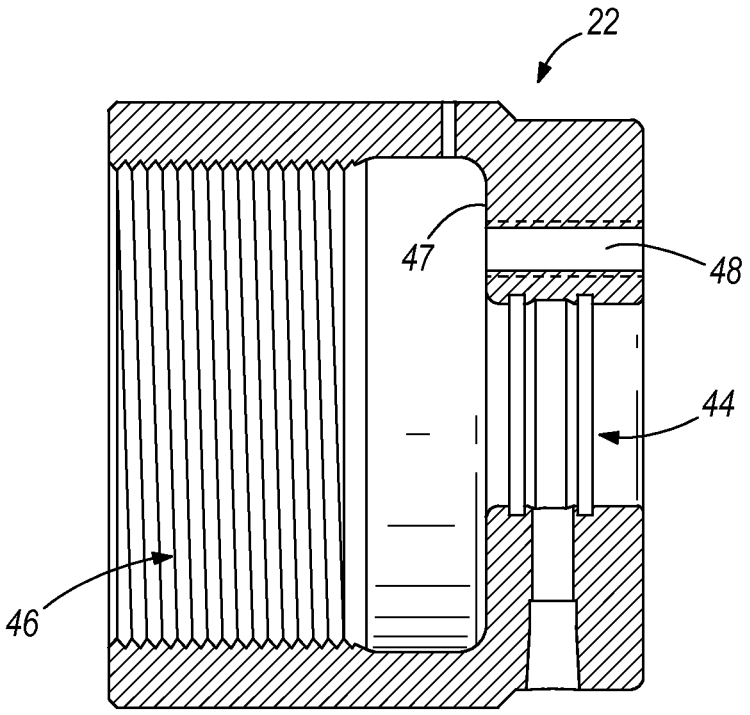
FIG. 2 is a section view of an end cap taken along line 9-9 of FIG. 1.

As illustrated in FIG. 2, a first end of the end cap 22 includes an opening 44 of cylindrical shape and a second end of the end cap 22 includes a threaded opening 46 of cylindrical shape. The threaded opening 46 is sized to receive one end of the hollow stud 24 as will be discussed. The threaded opening 46 cooperates with the first end of the end cap to define a shoulder 47. The first end of the end cap 22 includes a plurality of holes 48 (only one hole shown in FIG. 3) arranged such that a central axis of a hole 48 is substantially parallel to the central axis of the end cap 22. Each of the holes 48 includes threads and passes through the first end of the end cap 22 such that one end of the hole passes through the shoulder 47. In the illustrated construction, the opening 44 includes a pair of grooves that are sized to receive a sealing member. In other constructions, other arrangements are employed to define a seal in the opening 44.

Figure 3:
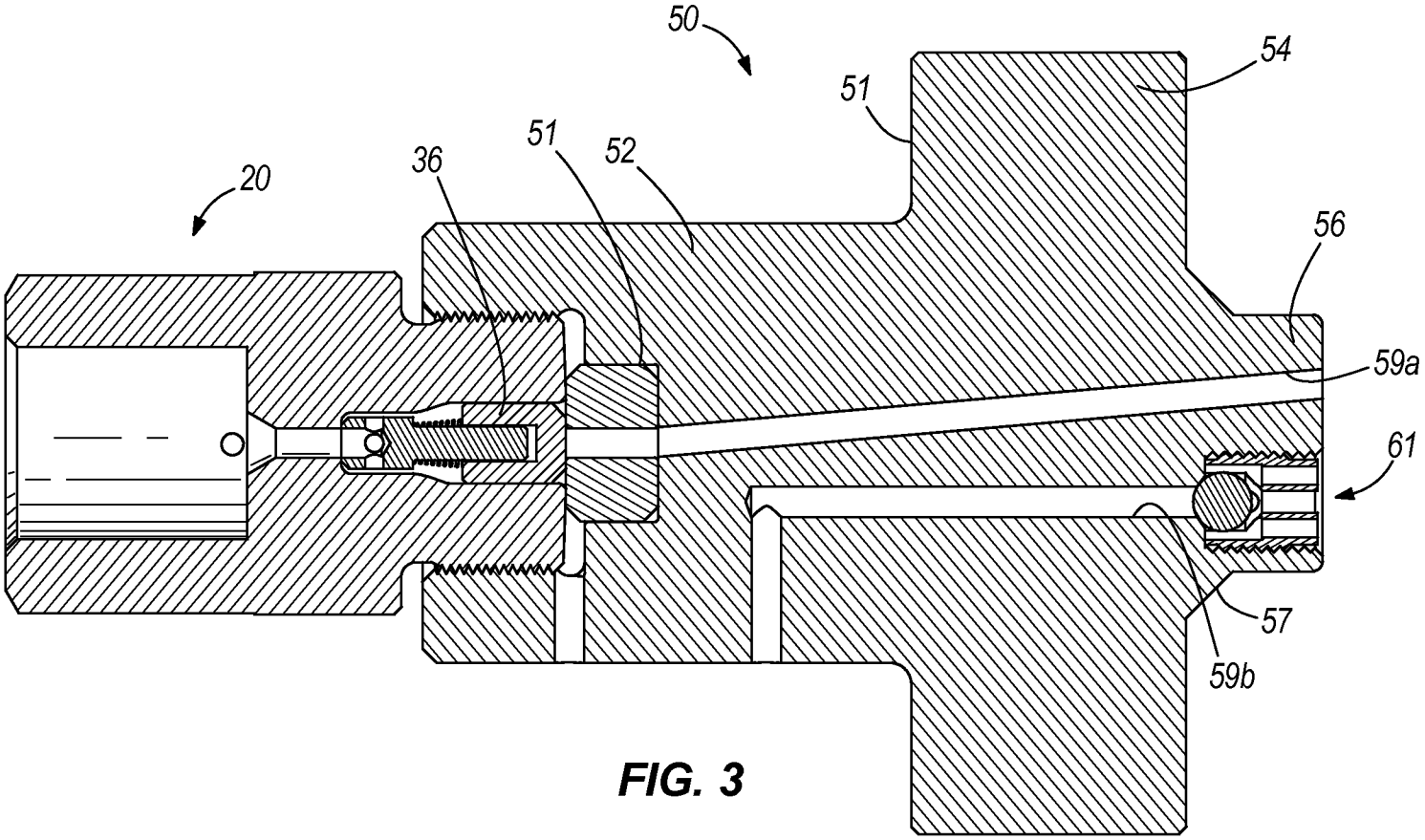
FIG. 3 is a section view of a sealing head taken along line 9-9 of FIG. 1.

FIG. 3 illustrates a sealing head 50 that includes a first portion 52, a middle portion 54, and a boss 56 that cooperate to define a central axis. The middle portion defines a shoulder 51 that is radially larger than the remainder of the sealing head 50. The boss 56 is a substantially cylindrical projection that extends from the middle portion 54. A chamfered seal surface 57 extends between the middle portion 54 and the boss 56. In addition, two flow paths 59*a*, 59*b* are formed in the sealing head 50 and include a first end that terminates at the end of the boss. One of the flow paths 59*a* is a discharge flow path and is operable to direct high pressure fluid out of the pump 10, while the second flow path 59*b* is an inlet flow path that provides for the flow of fluid into the pump 10 before it is pressurized by the pump 10. The second flow path 59*b* includes a check valve 61 positioned within the sealing head 50 that is operable to inhibit flow in one direction, while allowing substantially free flow in the opposite direction.

A discharge check valve 20 having a fluid check valve 36 disposed therein connects to the sealing head 50 through a check-valve seat 51 and operates to inhibit flow in one direction, while allowing high pressure fluid flow in the opposite direction. In the illustrated construction, the discharge check valve 20 is threadably connected to the sealing head 50. However, other constructions may employ other connection arrangements or may integrate the check valve 20 and the sealing head 50 into a single component.

Figure 4:
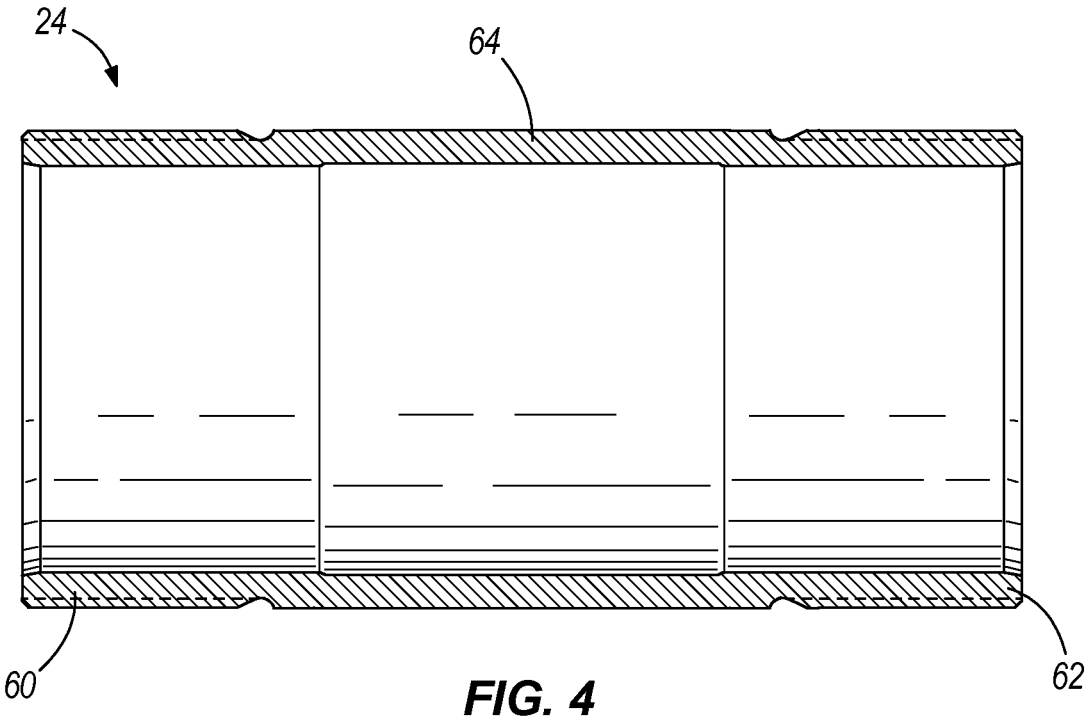
FIG. 4 is a section view of a hollow stud taken along line 9-9 of FIG. 1.

As illustrated in FIG. 4, the hollow stud 24 has a central axis about which the hollow stud 24 is generally cylindrical. In the illustrated construction, the first end 60 of the hollow stud 24 and the second end 62 of the hollow stud 24 have a smaller interior diameter than a middle portion 64 of the hollow stud 24 with other constructions having a uniform bore. Each end of the hollow stud 24 includes external threads sized to be received within the threaded opening 46 of the end cap 22 or a threaded opening 82 of a hydraulic cylinder head 26. In preferred constructions, multi-start thread arrangements are used. For example, in one preferred construction, quad threads are disposed on the exterior of the first end 60 and the second end 62 of the hollow stud 24. The quad threads include four separate threads that facilitate the desired alignment of the threaded components during assembly. In another preferred arrangement dual threads are disposed on the exterior of the first end 60 and the second end 62 of the hollow stud 24 to allow for thread engagement at two different starting locations. In alternative embodiments, single, triple or other numbers of start threads may be used in place of quad threads or dual threads. A thread undercut is disposed on the exterior of the hollow stud 24 next to the threads on the first end 60 and the second end 62. In another construction, the hollow stud 24 is fixed to the hydraulic cylinder head 26 via a flange that threads onto the hollow stud 24 and then is bolted to the hydraulic cylinder head 26. In this construction, the cylinder head 26 would not need to be threaded.

Figure 5:
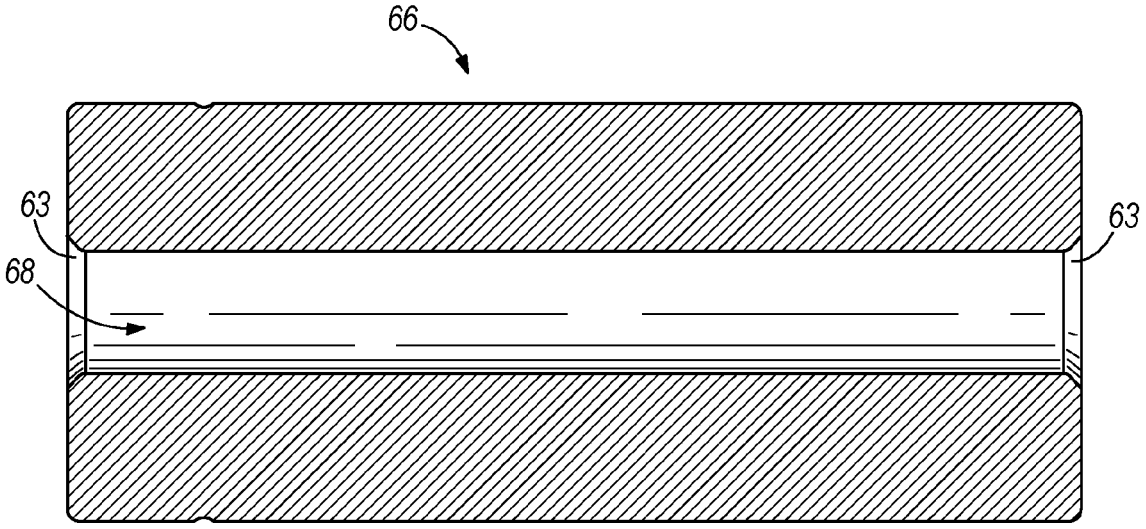
FIG. 5 is a section view of a high pressure cylinder taken along line 9-9 of FIG. 1.

FIG. 5 illustrates a high pressure cylinder 66 which includes a central axis about which the high pressure cylinder 66 is generally cylindrical. The interior of the high pressure cylinder 66 includes a cylindrical opening 68 which extends throughout the full length of the high pressure cylinder 66. The outside diameter of the high pressure cylinder 66 is sized to fit within the hollow stud 24. In preferred constructions, a close fit is provided between the outer surface of the high pressure cylinder 66 and the inner surface of the hollow stud 24 to inhibit lateral movement of the high pressure cylinder 66. The cylinder opening 68 includes a chamfer 63 on both ends to facilitate assembly and sealing.

Figure 6:
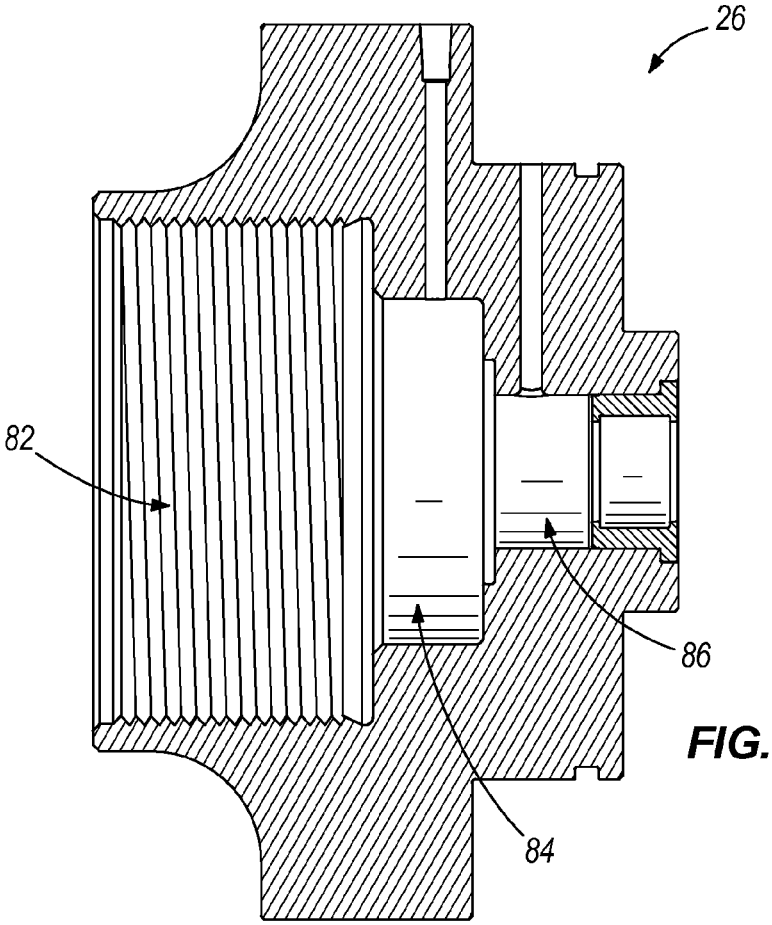
FIG. 6 is a section view of a hydraulic cylinder head taken along line 9-9 of FIG. 1

As illustrated in FIG. 6, a hydraulic cylinder head 26 includes a central axis and a main receiving bore 82 that is sized to receive one end of the hollow stud 24. The main receiving bore 82 includes threads that match the threads of the hollow stud 24. In addition, several cylindrical bores 84, 86 are formed in the hydraulic cylinder head and are sized to receive seal members to assure that hydraulic fluid does not leak past the hydraulic cylinder head 26.

With reference to FIG. 1, the hydraulic cylinder head 26 includes a plurality of apertures 104 arranged around the central axis of the cylinder head 26. The apertures 104 extend through the hydraulic cylinder head 26 and are sized to receive bolts 90 that facilitate the attachment of the hydraulic cylinder head 26 to the power cylinder 12. In the illustrated construction, six apertures 104 and six bolts 90 are provided with more or fewer apertures 104 and bolts 90 being possible.

Figure 7:
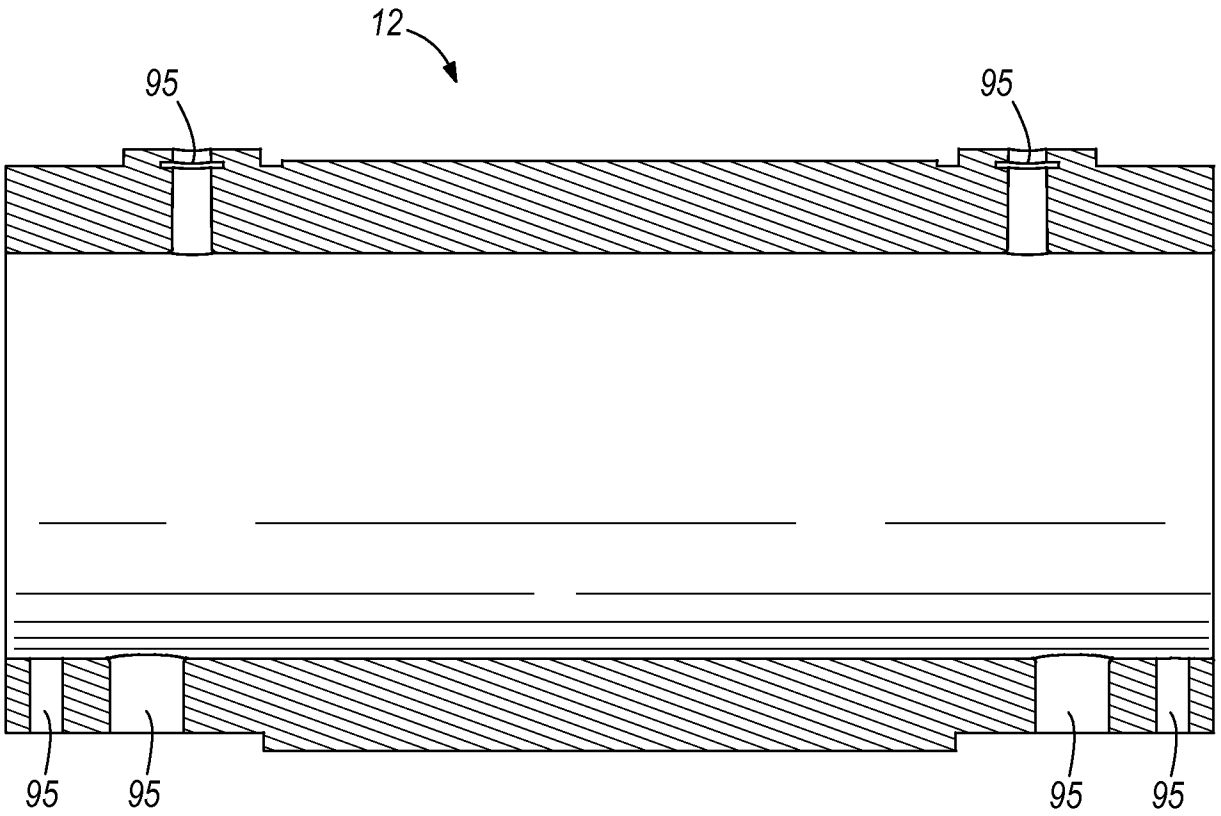
FIG. 7 is a section view of a power cylinder taken along line 9-9 of FIG. 1.

As illustrated in FIG. 7, the power cylinder 12 has a central axis about which the power cylinder 12 is generally cylindrical. The interior of the power cylinder 12 includes a hollow opening of cylindrical shape which exists throughout the power cylinder 12. A plurality of openings 95 extend through a sidewall of the power cylinder 12 with each opening 95 having an axis which is substantially perpendicular to the central axis of the power cylinder 12. The openings provide for hydraulic fluid flow into and out of the power cylinder 12 as well as access for proximity switches which are required to produce the desired reciprocating movement of a double-sided piston 100 (shown in FIG. 8) disposed within the cylinder 12.

With reference to FIG. 8, the assembly and operation of the high pressure pump 10 (sometimes referred to as an attenuator or attenuator pump) will be described. The double-sided piston 100 is positioned within the bore of the power cylinder 12 and a plunger 98 is attached to each side of the double-sided piston 100. Seal members are positioned within the two hydraulic cylinder heads 26 such that the two plungers 98 can pass through the seal members and form a seal. The hydraulic seal heads 26 are then bolted to the hydraulic cylinder 12. The seal members and the seal between the hydraulic seal heads 26 and the power cylinder 12 should be adequate to inhibit leakage of hydraulic fluid out of the power cylinder 12.

Each of the hollow studs 24 is then threaded into one of the two hydraulic seal heads 26 and each of the high pressure cylinders 66 is positioned within one of the hollow studs 24. Once positioned, the central bore 68 of each of the high pressure cylinders 66 receives the associated plunger 98 for reciprocation. Each of the seal heads 50 is positioned on one end of one of the high pressure cylinders 66 such that a seal is defined between the chamfer of the high pressure cylinder 66 and the chamfer 57 of the seal head 50. The seal must be such that it inhibits unwanted flow at the maximum operating pressure of the pump 10. To assure that the seal is capable of inhibiting leakage, the end cap 22 is threaded onto the hollow stud 24 to apply a compressive force on the seal head 50 and thereby increase the contact force at the seal between the seal head 50 and the high pressure cylinder 66 on each end of the pump 10.

The shoulder 51 of the seal head 50 is disposed adjacent the shoulder 47 of the end cap 22 when the end cap 22 is threaded onto the hollow stud 24. To apply the desired force to the seal head 50, a plurality of jack bolts 102 are threaded into the apertures 48 of the end cap 22. As the jack bolts 102 are turned, the ends engage the shoulder 51 of the seal head 50 and push the seal head 50 into the high pressure cylinder 66. The result is a large compressive force and preload on the high pressure cylinder 66. In addition, the hollow stud 24 is placed in tension and remains in tension throughout pump operation.

In operation, hydraulic fluid is directed to the power cylinder 12 to induce reciprocating movement of the double-sided piston 100. As illustrated in FIG. 8, high pressure hydraulic fluid has been forced into the space to the left of the double-sided piston 100, thereby moving the piston 100 to the right. The space to the right of the double-sided piston 100 is connected to a drain to allow the desired movement. To reverse the movement of the piston 100, the space to the left of the piston 100 is connected to the drain and the space to the right is connected to the high pressure hydraulic fluid source. Because the surface area of the piston 100 is significantly larger than the surface area of the plungers 98, the pressure of the hydraulic fluid can be substantially less than the operating pressure of the pump 10. As the pump 10 moves toward the position illustrated in FIG. 8, the intake check valve 61 in the left side seal head 50 opens to allow relatively low pressure fluid to enter the high pressure cylinder 66 on the left side. The discharge check valve 36 on the right side opens to allow the plunger 98 and high pressure cylinder 66 to discharge compressed fluid at the operating pressure of the pump 10. When the direction reverses, the open check valves on either side close and the closed check valves on either side open such that the right side cylinder 66 and plunger 98 cooperate to draw fluid in and the left side pump compresses fluid within the cylinder 66. No matter the position in the cycle, both hollow studs 24 remain in tension and both high pressure cylinders 66 remain in compression.

Thus, the invention provides, among other things, a high pressure pump 10 where there is tension on the end cap 22, hollow stud 24, and hydraulic cylinder head 26 when the pump 10 is not compressing a fluid. Various features and advantages of the invention are set forth in the following claims.

We claim:

1. A high-pressure fluid pump operable to pressurize a fluid, the pump comprising:

a hollow stud including a first end, a second end, and a cylindrical space extending axially between the first end and the second end;

a housing fixedly coupled to the first end of the hollow stud;

a high pressure cylinder disposed within the cylindrical space of the hollow stud, the hollow stud not inhibiting axial movement of the high pressure cylinder within the cylindrical space, the high pressure cylinder including a bore that extends from a first end to a second end of the high pressure cylinder, the hollow stud having a wall thickness that is substantially thinner than a wall thickness of the high pressure cylinder;

a seal head engaged with the second end of the high pressure cylinder to define a seal therebetween;

an end cap coupled to the second end of the hollow stud and the seal head, the end cap operable to apply an axial compressive force to the seal head to compress the seal head against the cylinder and to apply a tensile load axially to substantially the entire length of the hollow stud; and a plunger movable within the bore to pressurize the fluid in a space defined by the plunger, the seal head, and the high pressure cylinder.

2. The high-pressure fluid pump of claim 1, further comprising a plurality of jack bolts threadably coupled to the end cap and engageable with the seal head to apply the compressive force to the seal head to compress the seal head against the cylinder and to apply a tensile load to the hollow stud.

3. The high-pressure fluid pump of claim 1, wherein the first end of the hollow stud and the second end of the hollow stud include external threads and the housing and the end cap include internal threads arranged to engage the external threads.

4. The high-pressure fluid pump of claim 3, wherein the external threads are arranged as double threads.

5. The high-pressure fluid pump of claim 1, wherein the seal head includes an inlet check valve positioned to allow a flow of fluid into the high pressure cylinder in response to a drop in pressure below a predefined pressure within the space.

6. The high-pressure fluid pump of claim 1, wherein the seal head includes a discharge check valve positioned to allow a flow of fluid out of the high pressure cylinder in response to an increase in pressure above a predefined pressure within the space.

7. The high-pressure fluid pump of claim 6, wherein the predefined pressure is above 30,000 psi (2,069 bars).

8. A high-pressure fluid pump operable to pressurize a fluid, the pump comprising:

a high pressure cylinder including a wall having a first wall thickness and defining a bore and a high pressure end;

a plunger positioned at least partially within the bore;

a power source operable to produce a reciprocating motion of the plunger within the bore;

a housing;

a hollow stud having a wall having a second wall thickness and defining a first end fixedly coupled to the housing and a cylindrical space that extends between the first end and a second end of the hollow stud, the high pressure cylinder disposed at least partially within the cylindrical space, wherein the first wall thickness is substantially larger than the second wall thickness;

a seal head positioned in contact with the high pressure end of the high pressure cylinder such that the seal head, the high pressure cylinder and the plunger cooperate to define a variable volume space that receives the fluid to be pressurized;

an end cap coupled to the second end of the hollow stud and operable to apply an axial compressive force to the seal head and the entire length of the high pressure cylinder to maintain a seal therebetween at operating pressures in excess of 30,000 psi (2,069 bars) and to apply an axial tensile force to substantially the entire length of the hollow stud.

9. The high-pressure fluid pump of claim 8, further comprising a plurality of jack bolts threadably coupled to the end cap and engageable with the seal head to apply the compressive force to the seal head to compress the seal head against the cylinder and to apply the tensile force to the hollow stud.

10. The high-pressure fluid pump of claim 8, wherein the first end of the hollow stud and the second end of the hollow stud include external threads and the housing and the end cap include internal threads arranged to engage the external threads.

11. The high-pressure fluid pump of claim 10, wherein the external threads are arranged as multi-start threads.

12. The high-pressure fluid pump of claim 8, wherein the seal head includes an inlet check valve positioned to allow a flow of fluid into the high pressure cylinder in response to a drop in pressure below a predefined pressure within the space.

13. The high-pressure fluid pump of claim 8, wherein the seal head includes a discharge check valve positioned to allow a flow of fluid out of the high pressure cylinder in response to an increase in pressure above a predefined pressure within the space.

14. A high-pressure fluid pump operable to pressurize a fluid, the pump comprising:

a power cylinder having a hydraulic drive member disposed therein;

a first housing coupled to a first end of the power cylinder and cooperating with the power cylinder and the drive member to define a first space;

a second housing coupled to a second end of the power cylinder and cooperating with the power cylinder and the drive member to define a second space;

a first hollow stud having a first end connected to the first housing and a second end;

a first head assembly in contact with the second end of the first hollow stud;

a first high pressure cylinder disposed within the first hollow stud and having a first cylindrical bore that at least partially defines a space, the first head assembly being adjustable to apply an axial tensile load to substantially the entire length of the first hollow stud and to axially compress the entire length of the first high pressure cylinder between the first head assembly and the first housing, the first hollow stud having a wall thickness that is substantially less than a wall thickness of the first high pressure cylinder;

a first plunger disposed within the first cylindrical bore;

a second hollow stud having a first end connected to the second housing and a second end;

a second head assembly in contact with the second end of the second hollow stud;

a second high pressure cylinder disposed within the second hollow stud and having a second cylindrical bore, the second head assembly being adjustable to apply an axial tensile load to substantially the entire length of the second hollow stud and to axially compress the entire length of the second high pressure cylinder between the second head assembly and the second housing, the second hollow stud having a wall thickness that is substantially less than a wall thickness of the second high pressure cylinder; and a second plunger disposed within the second cylindrical bore, the first plunger and the second plunger movable in response to movement of the drive member and in opposition to one another to pressurize the fluid to a pressure in excess of 30,000 psi (2,069 Bar).

15. The high-pressure fluid pump of claim 14, wherein the first head assembly includes a first seal head and a first end cap and the second head assembly includes a second seal head and a second end cap.

16. The high-pressure fluid pump of claim 15, further comprising a first plurality of jack bolts threadably coupled to the first end cap and engageable with the first seal head to apply a compressive force to the first seal head to compress the first seal head against the first high pressure cylinder and to apply the tensile load to the first hollow stud.

17. The high-pressure fluid pump of claim 16, further comprising a second plurality of jack bolts threadably coupled to the second end cap and engageable with the second seal head to apply a compressive force to the second seal head to compress the second seal head against the second high pressure cylinder and to apply the tensile load to the second hollow stud.

18. The high-pressure fluid pump of claim 14, wherein the first end of the first hollow stud and the second end of the first hollow stud include multi-start external threads and the first housing and the first head assembly include internal threads arranged to engage the external threads.

19. The high-pressure fluid pump of claim 18, wherein the external threads are arranged as dual threads.

20. The high-pressure fluid pump of claim 14, wherein the first head assembly includes an inlet check valve positioned to allow a flow of fluid into the first high pressure cylinder in response to a drop in pressure below a predefined pressure within the space.

21. The high-pressure fluid pump of claim 20, wherein the first head assembly includes a discharge check valve positioned to allow a flow of fluid out of the first high pressure cylinder in response to an increase in pressure above a predefined pressure within the space.

* * * * *